US007780371B2

(12) United States Patent
Daubner

(10) Patent No.: US 7,780,371 B2
(45) Date of Patent: Aug. 24, 2010

(54) SUPPORTING FRAMEWORK COMPRISING CONNECTION NODES AND STRUTS, CONNECTION NODES, CONNECTION ELEMENT FOR PRODUCING A DIAGONAL CONNECTION BETWEEN A CONNECTION NODE AND STRUTS OF A SUPPORTING FRAMEWORK, AND CONNECTION ELEMENT FOR PRODUCING A HOLDING DEVICE FOR A FLAT ELEMENT

(75) Inventor: Michael Daubner, Stuttgart (DE)

(73) Assignee: Burkhardt Leitner Constructiv GbmH & Co., KG, Stuttgart (DE)

( * ) Notice: Subject to any disclaimer, the term of this patent is extended or adjusted under 35 U.S.C. 154(b) by 124 days.

(21) Appl. No.: 11/883,857

(22) PCT Filed: Jan. 10, 2006

(86) PCT No.: PCT/EP2006/000131

§ 371 (c)(1),
(2), (4) Date: Aug. 7, 2007

(87) PCT Pub. No.: WO2006/087051

PCT Pub. Date: Aug. 24, 2006

(65) Prior Publication Data

US 2008/0175655 A1 Jul. 24, 2008

(30) Foreign Application Priority Data

Feb. 16, 2005 (DE) ..... 10 2005 009 172

(51) Int. Cl.
*E04B 1/19* (2006.01)

(52) U.S. Cl. ..... 403/171; 403/176; 211/189; 52/655.1

(58) Field of Classification Search ..... 403/171, 403/173, 176, 169, 170; 312/140; 211/182, 211/189; 52/81.3, 655.1, 655.2; 434/277, 434/278, 281; 135/122
See application file for complete search history.

(56) References Cited

U.S. PATENT DOCUMENTS 2,658,776 A * 11/1953 Wilcox ..... 403/170

(Continued)

FOREIGN PATENT DOCUMENTS

AU 46654 96 10/1996

(Continued)

OTHER PUBLICATIONS

Office Action of State Intellectual Property Office of People's Republic of China, mailed Jan. 23, 2009, for Application No. 2006800005812, 7 Pages.

(Continued)

*Primary Examiner*—Michael P Ferguson
(74) *Attorney, Agent, or Firm*—Harness, Dickey & Pierce, P.L.C.

(57) ABSTRACT

A supporting framework with connection node and struts has at least two strut receiving elements, each strut receiving element being arranged centrally on an imaginary cube face of the connection node. Arms extend from the strut receiving elements and run parallel to the edges of the imaginary cube face and extend up to an edge of the imaginary cube face that is perpendicular to the arms. The arms of one strut receiving element meet arms of an adjacent strut receiving element arranged orthogonal thereto and form at least one loop. A connection element can be hooked into the loop for producing a diagonal connection.

8 Claims, 5 Drawing Sheets

U.S. PATENT DOCUMENTS

| | | | | | |
|---|---|---|---|---|---|
| 3,356,394 | A | * | 12/1967 | Chamayou | 403/171 |
| 4,324,083 | A | * | 4/1982 | Johnson, Jr. | 403/172 |
| 4,982,546 | A | * | 1/1991 | Lange | 403/174 |
| 4,993,687 | A | | 2/1991 | Crook et al. | |
| 5,030,103 | A | * | 7/1991 | Buist et al. | 434/278 |
| 5,056,291 | A | * | 10/1991 | Leung | 52/637 |
| 5,074,094 | A | | 12/1991 | Gassler | |
| 5,700,102 | A | | 12/1997 | Feleppa | |
| 6,247,869 | B1 | * | 6/2001 | Lichvar | 403/169 |
| 6,792,732 | B2 | * | 9/2004 | Strassle et al. | 403/171 |

FOREIGN PATENT DOCUMENTS

| | | | |
|---|---|---|---|
| DE | 666 217 | C | 10/1938 |
| DE | 11 76 810 | B | 8/1964 |
| DE | 295 04 434 | U | 5/1995 |
| DE | 195 12 675 | C2 | 9/1996 |
| EP | 0 684 394 | A | 11/1995 |
| SU | 686943 | | 9/1979 |
| WO | 96 28621 | | 9/1996 |

OTHER PUBLICATIONS

Office Action issued in Russian Application 2007101171 based on PCT/EP2006/100031.

* cited by examiner

SUPPORTING FRAMEWORK COMPRISING CONNECTION NODES AND STRUTS, CONNECTION NODES, CONNECTION ELEMENT FOR PRODUCING A DIAGONAL CONNECTION BETWEEN A CONNECTION NODE AND STRUTS OF A SUPPORTING FRAMEWORK, AND CONNECTION ELEMENT FOR PRODUCING A HOLDING DEVICE FOR A FLAT ELEMENT

CROSS-REFERENCE TO RELATED APPLICATIONS

This application is a National Stage of International Application No. PCT/EP2006/000131, filed Jan. 10, 2006. This application claims the benefit of DE 10 2005 009 172.5, filed Feb. 16, 2005. The disclosure of the above applications is incorporated herein by reference.

FIELD

The invention relates to a supporting framework having a connection node and struts, a connection node, a connection element for producing a diagonal connection between a connection node and struts of a supporting framework, and a connection element for producing a holding device for a flat element in accordance with the preambles to the independent claims.

BACKGROUND

Supporting frameworks of the type addressed herein have been known for a long time. They connect profiles, called supporting elements, to one another such that a framework structure or a supporting framework results, into which for instance wall elements or shelf elements can be placed. Such supporting frameworks represent a secure connection of elements that can be plugged in and are therefore particularly suitable for the field of exhibition construction and shelf construction. However, the loadability of known types of supporting frameworks is limited.

It is therefore the object of the invention to create a supporting framework that is suitable for producing statically stable surfaces or wall elements.

This object is inventively attained using the features of the independent claims.

SUMMARY

In accordance with the invention, a supporting framework having a connection node and struts is suggested, and a connection node is suggested, the connection node having at least two strut receiving elements that are each arranged centrally on an imaginary cube face of the connection node. Extensions in the form of arms extend from the strut receiving elements and run parallel to the imaginary edges of the imaginary cube face and extend to an edge of the imaginary cube face that runs perpendicular to the arms. The arms preferably also extend parallel to the cube face. Each arm of a strut receiving element meets an arm, arranged orthogonal thereto, of an adjacent strut receiving element on the orthogonally arranged cube face and forms at least one loop. Preferably at least six strut receiving elements are provided, each with arms running cross-wise. For producing a diagonal connection in a surface mounted by connection node and struts, a hook-shaped connection element can be hooked into the at least one loop of the connection node and another hook-shaped connection element can be hooked into the loop diagonally opposite thereto. A connection between the connection node and the struts is thus advantageously stabilized by diagonal struts, and it is possible to construct statically stable surfaces and also bearing elements with high load carrying ability using this construction. For instance, self-supporting elements having a length of up to about 10 m can be produced. The hook-shaped connection element can be provided for attaching a mountable diagonal strut. The inventive supporting framework is thus suitable preferably for covers, but also for racks and other loadable surfaces.

Preferably largely round strut receiving elements, each having four arms distributed uniformly on the circumference, are arranged on each imaginary cube face of the connection node so that the connection node has a total of six strut receiving elements, the arms of which meet the adjacent arms arranged orthogonal thereto, forming a total of twelve loops. The connection node is thus not only esthetically pleasing, but also is suitable for numerous combination options for supporting frameworks, for instance also in combination with a wall holder.

The hook-shaped connection element can usefully be brought into a self-locking connection that when loaded can be placed under tension. With this design it is possible to attain in particular diagonal bracing. An inventive connection element includes at least one hook element, one tensioning sleeve, and one fixing element. For stabilizing the connection, the hook element can be provided with a barb, so that the hook-shaped connection element locks in the loop. It can also be provided that the arms that meet one another orthogonally maintain a distance from one another that is preferably smaller than a diameter of the hook. The distance is for instance 2 to 3 mm. Further retention of the hook in the loop can be obtained by shaping the hook appropriately, for instance as a catch.

At its free end that faces away from the connection node when assembled, the hook element preferably has a receiving opening into which the diagonal strut can be inserted. The diagonal strut is preferably made of wire, so that particularly advantageous tensile strength can be attained. However, it can also be provided that the diagonal strut is embodied as a rod, for instance a telescoping rod, or another support element of a known type. It is particularly preferred when, at each of its free ends, the diagonal strut has an expansion, for instance in the form of a cap pressed on both sides that when assembled locks in the correspondingly embodied receiving opening of the hook element. The connection element and the diagonal strut can be connected by means of the tensioning sleeve for fixing this connection. The holding force of conventional tensioning sleeves advantageously does not become weaker, even when used frequently and under heavy loads, so that it is thus possible to produce a stable connection. Especially in exhibition construction these criteria are critical because exhibition stands are put together and taken apart so frequently. In order to facilitate assembly, the surface of the tensioning sleeve can be provided with a grip structure. Then the connected elements can be enclosed in a fixing element, for instance a fixing tube, preferably made of plastic, which provides additional protection against undesired spontaneous loosening.

The hook-shaped connection element can also be provided for receiving a holding device, for instance for a flat element, in particular a wall element. In this preferred embodiment, the hook-shaped connection element is embodied as a wall plate holder. However, any other suitable material such as fabric, films, hard fillings, glass, or the like can also be held in the holding device. The connection element is preferably designed such that after being hooked in the loop it is self-supporting in order to facilitate assembly of the flat elements. The holding device embodied as wall plate holder can for instance be embodied as a plate holding hook and includes a hook element that can be hooked into the loops of the connection node and a first disk-shaped element, for instance a plastic disk, arranged on the opposing free end of the connection element. A second disk-shaped element, for instance a screw-in tensioning sleeve, is usefully provided for producing a clamping apparatus for a wall element, whereby the wall element can be clamped and fixed between the first disk-shaped element and the screw-in tensioning sleeve.

An inventive connection element for producing a holding device for a wall element includes at least one hook element and a first disk-shaped element that in conjunction with a second disk-shaped element embodies a holding device for a wall element.

The disk-shaped elements have in particular a central bore for receiving a connection means. Plastic disks and spacers can be provided for fixing and stabilizing the wall element clamped between the disks. It is particularly preferred when the second disk-shaped element has a longitudinal hole, so that stabilization of the elements in all directions like an adapter can be advantageously attained.

With the present invention it is possible to produce, with no tools, a pre-tensioned, stable supporting framework system that is capable of bearing a load and that can be combined and expanded as desired with standardized connection elements, like a modular system.

All connection elements can be produced easily with a conventional punch and bending process so that it is possible to keep production costs low. To the extent possible, all struts and diagonal struts are made of aluminum to enable light-weight construction and to reduce the total weight of the supporting framework. The other elements are preferably made of high quality stainless steel casting. The supporting framework is very light-weight and when taken apart occupies very little volume, which has a positive effect on transportability.

Additional embodiments, aspects, and advantages of the invention also result independent from their inclusion in claims, without limiting the generality using exemplary embodiments of the invention depicted in the drawings.

DRAWINGS

The invention is explained in greater detail in the following using the drawings.

FIGS. 1 *a, b* depicts a section through an inventive connection node (FIG. 1*a*) and a perspective depiction of the connection node (FIG. 1*b*);

Figure 5A:
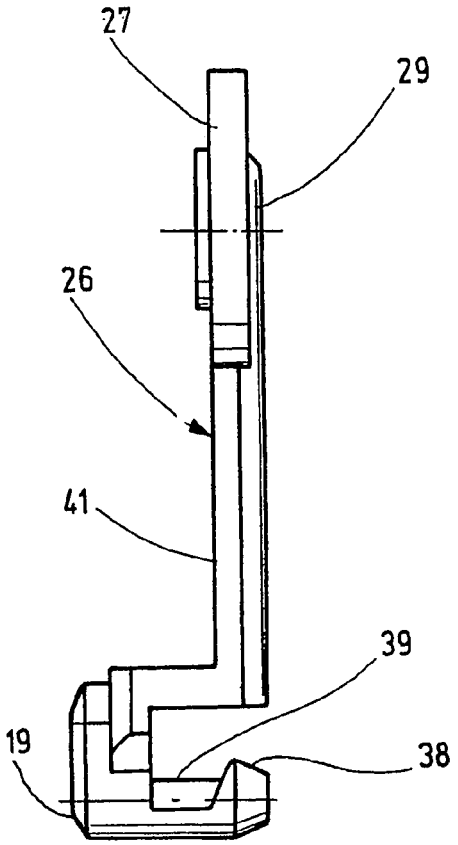
Figure 5B:
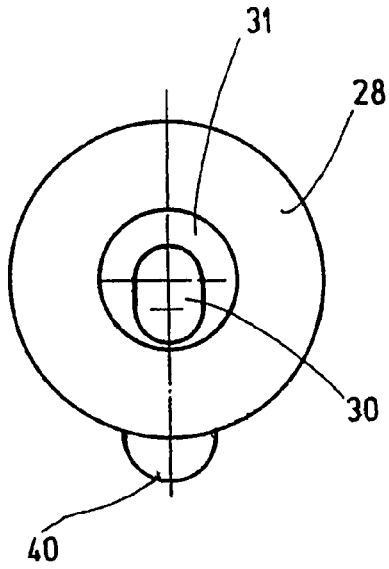
Figure 5C:
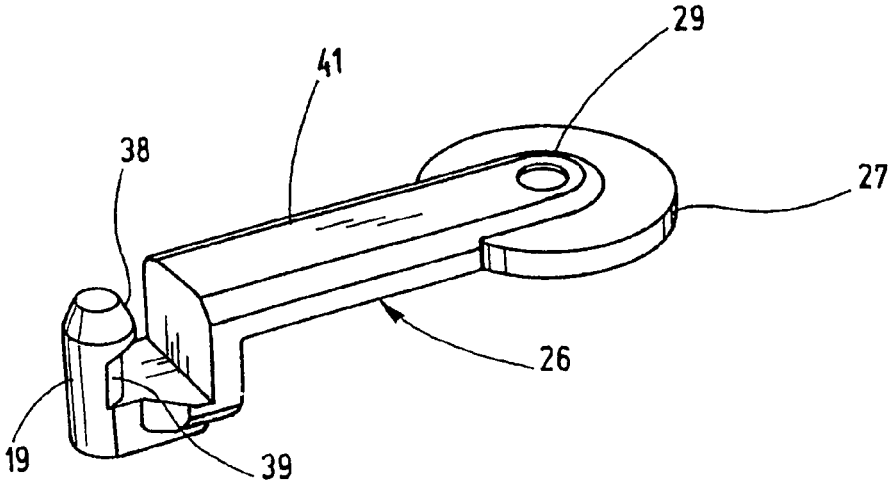

FIGS. 5 *a, b, c* is a side elevation of a holding device for a wall element (FIG. 5*a*), a section through a partial element of the holding device (FIG. 5*b*), and a perspective view of the holding device (FIG. 5*c*).

DETAILED DESCRIPTION

Figure 1A:
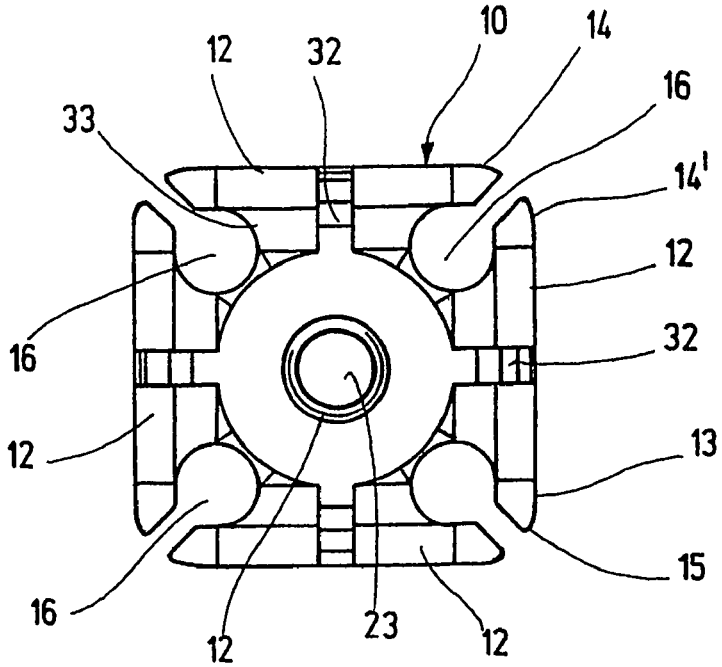
Figure 1B:
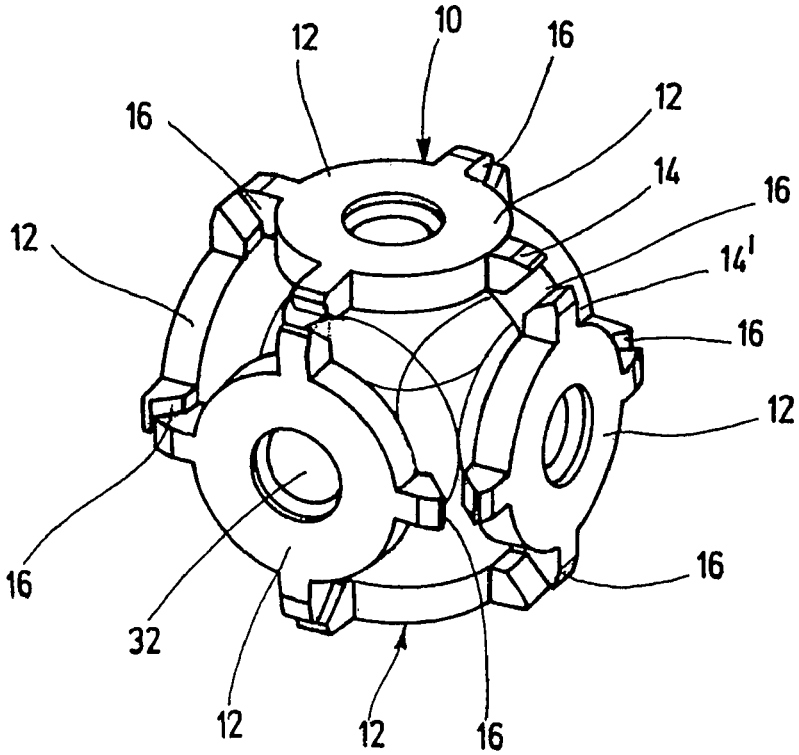

FIG. 1*a* depicts a section through an inventive connection node 10, and FIG. 1*b* is a perspective view.

The connection node 10 has a basically spherical shape and has regularly distributed mating bores 32 into which struts (not shown) can be inserted. However, it is also possible to embody the connection node 10 as a cube with square lateral surfaces or as a polyhedron. On the surface of the sphere the mating bores 32 are surrounded by ring-shaped strut receiving elements 12, the rings being wider than they are high and each being disposed on adapters 33 of the mating holes 32, the adapters expanding outward circumferentially. Each strut receiving element 12 is arranged in the center of an imaginary cube face 13 of the connection node 10. Extending from the strut receiving elements 12 are arms 14, 14' that are arranged cross-wise and that run parallel to edges 15 of the imaginary cube face 13 and parallel to this cube face 13 up to the edge 15 of the imaginary cube face 13. Associated with each strut receiving element 12 are four arms 14, 14' distributed uniformly on the circumference, the arms 14 of each strut receiving element 12 meeting arms 14' of adjacent, orthogonally arranged strut receiving elements 12, forming a loop 16 in each case. The connection node 10 has a total of six strut receiving elements 12, the arms of which form a total of twelve loops 16. The arms 14 can each remain spaced apart from one another. A hook-shaped connection element (not shown) can be hooked into each of the loops 16 in order for instance to produce a diagonal connection for the entire supporting framework.

Figure 2:
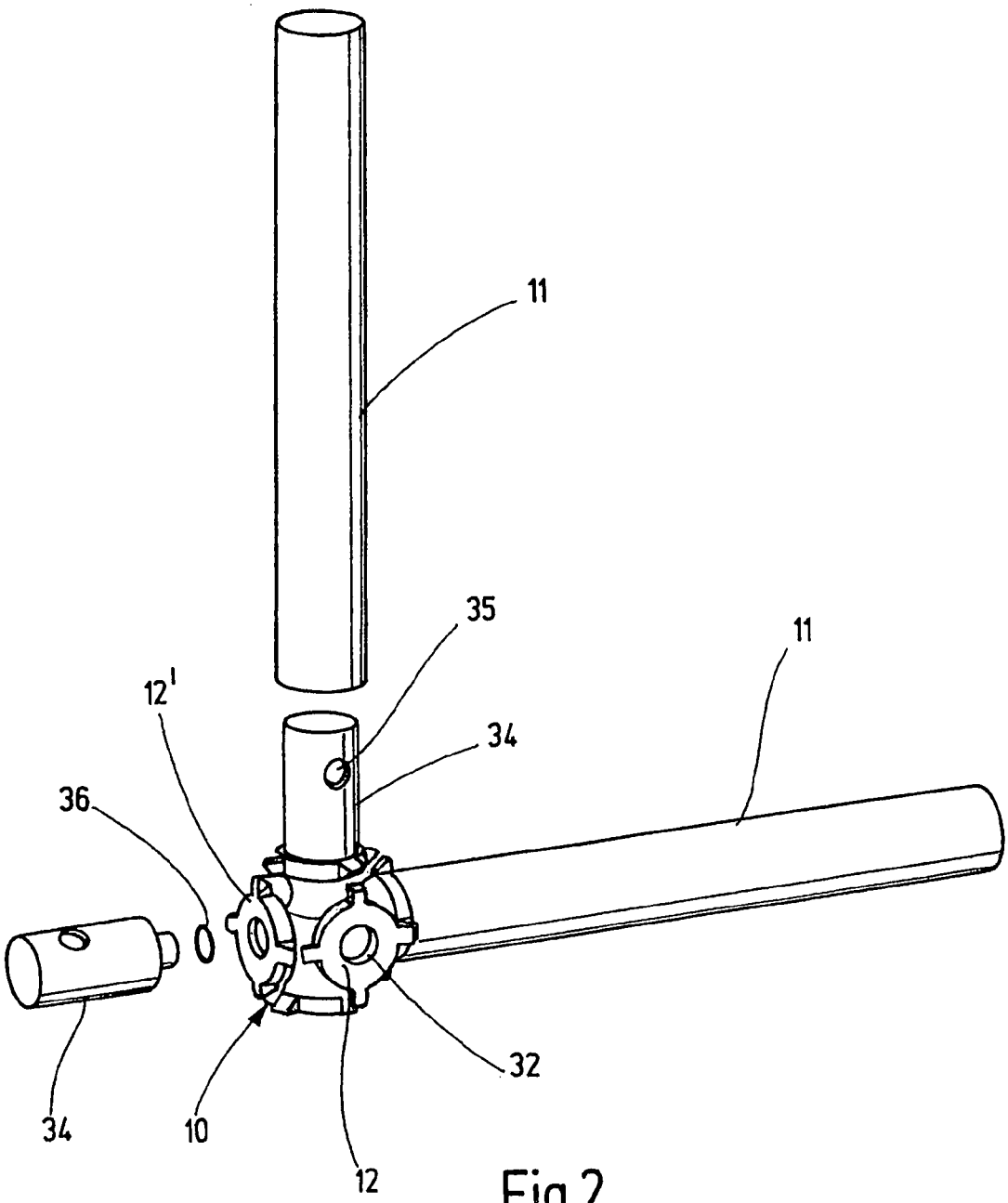
FIG. 2 depicts one embodiment of the inventive supporting framework with connection nodes and struts.

FIG. 2 depicts one embodiment form of an inventive supporting framework with connection nodes 10, the structure of which is consistent with the description for FIGS. 1*a* and 1*b*. Identical elements have the same reference numbers in the figures. Struts 11 or extension pieces 34 for struts 11 can be inserted into the mating holes 32 or strut receiving elements 12 of the connection node 10, for instance using a plug-in connection or by screwing it in. It can also be provided that the connection between the struts 12 and the connection node 10 is magnetic, at least one strut 11 having a magnet in the area of its inserted free end, for instance, and an associated counterpart in the connection node 10 being ferromagnetic. As needed the struts 11 can be connected directly to the connection node 10 or can be connected via extension pieces 34. The extension pieces 34 have a bevel 35 that can act as a viewing hole and thus make it easier to check the stability of the connection. Where necessary a tool can also be inserted via the bevel 35. During assembly of the extension piece 34, an intermediate ring 36 can be added between the connection node 10 and the extension piece 34 for stabilizing the connection.

Figure 3:
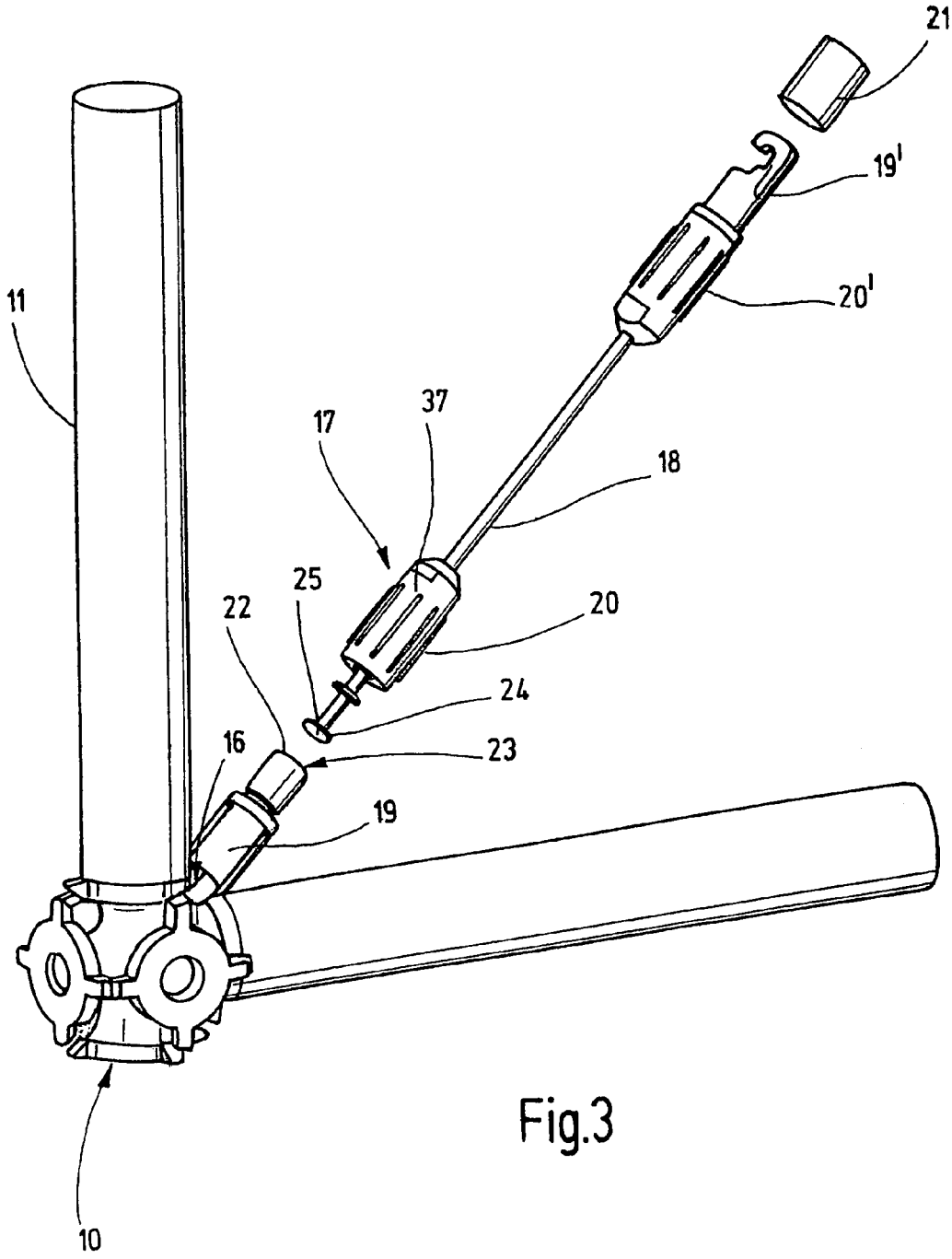
FIG. 3 depicts an alternative embodiment of the inventive supporting framework with diagonal bracing.

FIG. 3 depicts an alternative embodiment of an inventive supporting framework having a connection node 10, the structure of which is also consistent with the description for FIGS. 1 and 2. A diagonal strut 18 is provided for stabilizing the supporting framework, and it is attached to the connection node 10 by means of a connection element 17. The connection element 17 includes a hook element 19, 19' arranged on both sides of the diagonal strut 18, a tensioning sleeve 20, 20', and a fixing element 21, which are shown in an exploded depiction in FIG. 3. The hook element 19, 19' of the connection element 17 is connected in a self-locking manner to the loop 16 of the connection node 10 and when loaded is under tension. The hook element 19, 19' has, at its free end 22 that faces away from the connection node 10 when assembled, a receiving opening 23 into which the diagonal strut 18 can be inserted. The diagonal strut 18 in FIG. 3 is made of wire and has at each of its free ends 24 a cap-like expansion 25 that when assembled locks into the correspondingly embodied receiving opening 23 of the hook element 19, 19'. The connection element 17 and the diagonal strut 18 are mounted by means of the tensioning sleeves 20, 20'. On its surface, the tensioning sleeve 20, 20' has a grip structure 37 to facilitate the manual tensioning process and to prevent slipping.

When assembled, the connection element 17 is enclosed by the fixing sleeve 21 to prevent the connection from spontaneously coming undone.

Figure 4:
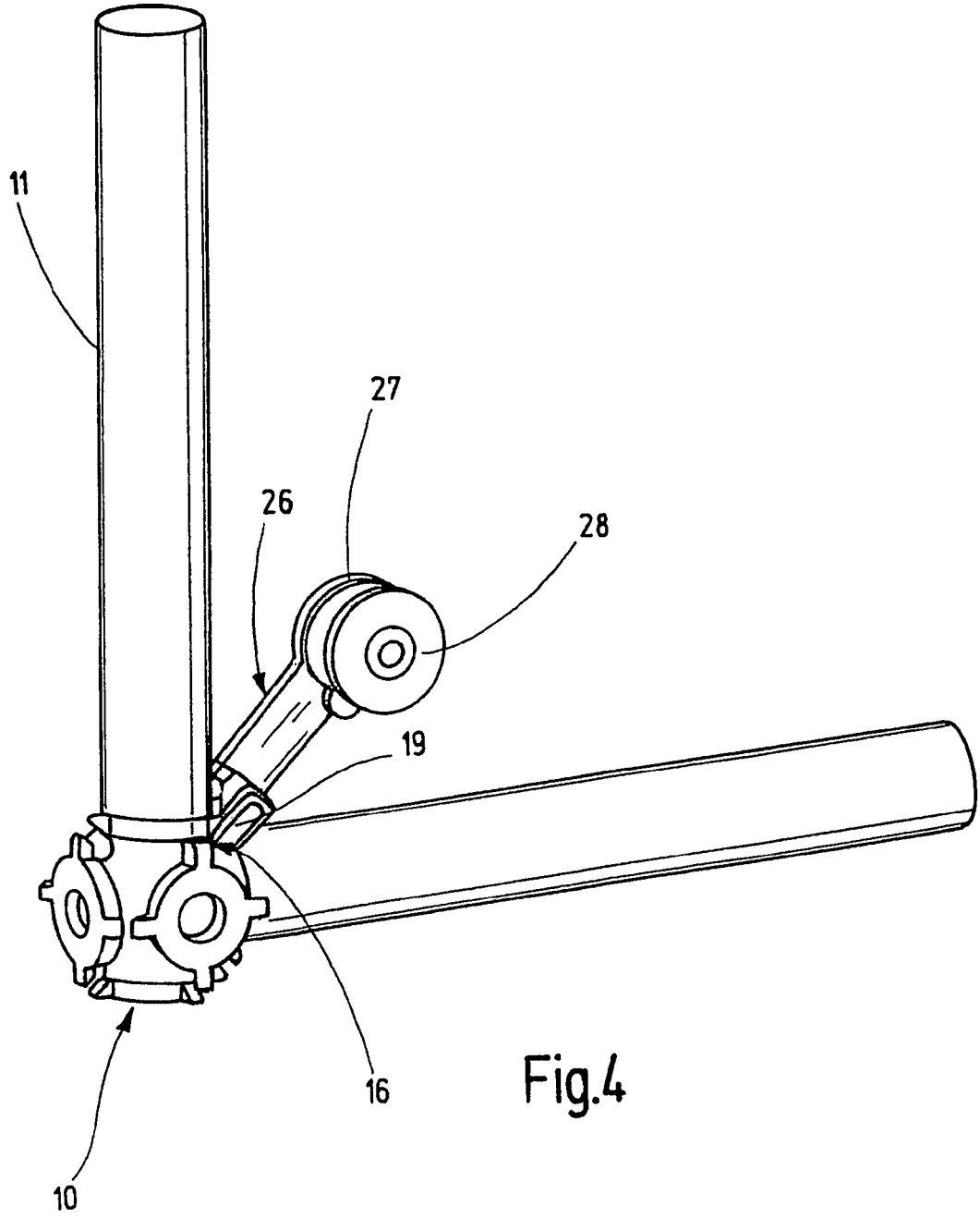
FIG. 4 depicts another alternative embodiment of the inventive supporting framework with a wall holder.

FIG. 4 depicts an alternative embodiment of an inventive supporting framework. Instead of a diagonal brace illustrated in FIG. 3, the connection element 17 is embodied as a holding device 26 for a wall element (not shown). In the same manner as described in the foregoing, the holding device 26 has a hook element 19 that is hooked into a loop 16 of a connection node 10. At a free end facing away from the hook element 19, the holding device 26 has a first disk-shaped element 27. In addition, a correspondingly dimensioned second disk-shaped element 28 is provided that, with the first disk-shaped element 27, embodies a clamping apparatus for a wall element (not shown).

FIGS. 5*a*, 5*b*, and 5*c* depict the precise structure of the holding device 26; FIG. 5*a* is a side elevation of the holding device 26 illustrated with a hook element 19, a bearing element 41, and a first disk-shaped element 27. The hook element 19 has a barb 38 that also makes it possible for the hook element 19 to lock in the loop (not shown]. An area 39 of the hook element 19 that faces the loop when assembled is embodied flattened on both sides, not round, in cross-section. This makes it possible to attain further retention of the hook element 19 in the loop if the latter is not completely closed, as is described in the foregoing. The hook element 19 is preferably configured such that it is self-supporting once it has been placed in the loop, in order to facilitate mounting of the flat elements. The first disk-shaped element 27 is arranged at a free end of the holding device 26 that faces away from the hook element 19. A base surface of the first disk-shaped element 27 is arranged transverse to the longitudinal extension of the hook element 19. The first disk-shaped element 27 has a central bore 29 for receiving a connection means (not shown).

FIG. 5*b* is a top view of a second disk-shaped element 28 that is embodied as a screw-in tensioning sleeve and that is dimensioned corresponding to the first disk-shaped element 27 and that has a tab 40 that can be used as an aid during assembly. Arranged in the second disk-shaped element 28 is a central bore 30 in which the connection means (not shown) is received and to which the disk-shaped element 27 can be connected. A wall element (not shown) provided with a corresponding bore can thus be clamped between the first and the second disk-shaped elements 27, 28. When assembled, plastic disks or tube sections (not shown) can be arranged between the wall element and the disk-shaped elements 27, 28. The bore 30 of the second disk-shaped element 28 is embodied as a longitudinal hole so that stabilization of the elements in all directions can advantageously be attained like a type of adapter. A central spacer 31 is arranged on the second disk-shaped element 28 around the longitudinal hole 30.

The invention claimed is:

1. A supporting framework comprising:

a plurality of connection nodes, each connection node comprising:

a central core with an outer surface having a sphere or a polyhedron shape;

a plurality of projections extending from the core and defining respective outer planar faces, each projection including a mating bore extending radially inward toward the core, the plurality of projections comprising six projections uniformly arranged around and extending from the core such that the planar faces of the projections lie on a corresponding plurality of sides of an imaginary cube; and a plurality of arms unitarily formed with and extending from each of the projections, the arms being uniformly spaced about a peripheral edge of each projection such that along each edge of the imaginary cube, adjacent arms of respective adjacent projections are aligned and extend toward one another and arranged orthogonal thereto to form a loop, each loop defining a receiving space radially between the respective adjacent arms and the outer surface of the central core;

at least one strut, each strut having a first end inserted into a mating bore of one of the projections of a first one of said connection nodes and a second end inserted into a bore of a projection of another said connection node; and at least one diagonal strut, each diagonal strut having a connection element connected to a first end of the diagonal strut, the connection element being received and retained within the receiving space of one of the loops of said first one of said connection nodes, and a second end of the diagonal strut having a second said connection element received within the receiving space of a loop of another said connection node, producing a diagonal connection.

2. The supporting framework in accordance with claim 1, wherein each connection element can be brought into a connection with a respective loop without discrete fasteners, which connection can be placed under tension when loaded.

3. The supporting framework in accordance with claim 1, wherein each connection element includes a hook element received within the receiving space and arranged on the first end of the diagonal strut, a tensioning sleeve which connects the connection element to the diagonal strut, and a fixing element for providing additional protection against undesired spontaneous loosening of the connection between the diagonal strut and the connection element.

4. The supporting framework in accordance with claim 3, wherein the hook element has at a free end facing away from the connection node when assembled, a receiving opening into which the diagonal strut can be inserted.

5. The supporting framework in accordance with claim 3, wherein the diagonal strut has an expansion at each of its free ends that locks in a correspondingly embodied receiving opening of a respective hook element when assembled.

6. The supporting framework in accordance with claim 3, wherein the connection element is enclosed by the fixing element when assembled.

7. The supporting framework in accordance with claim 4, wherein the diagonal strut is made of wire.

8. The supporting framework in accordance with claim 1, wherein the diagonal strut is a rod.

* * * * *

UNITED STATES PATENT AND TRADEMARK OFFICE
Certificate

Patent No. 7,780,371 B2 Patented: August 24, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michael Daubner, Stuttgart (DE); Robert Glanz, Stuttgart (DE); and Andreas Dober, Stuttgart (DE).

Signed and Sealed this Seventh Day of May 2013.

DANIEL P. STODOLA
*Supervisory Patent Examiner*
Art Unit 3679
Technology Center 3600